US008128088B2

(12) United States Patent
Suh et al.

(10) Patent No.: US 8,128,088 B2
(45) Date of Patent: Mar. 6, 2012

(54) COMBINED SHEET BUFFER AND INVERTER

(75) Inventors: Eun Suk Suh, Rochester, NY (US); Henry T. Bober, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 425 days.

(21) Appl. No.: 12/413,923

(22) Filed: Mar. 30, 2009

(65) Prior Publication Data

US 2010/0244354 A1 Sep. 30, 2010

(51) Int. Cl.
*B65H 39/10* (2006.01)

(52) U.S. Cl. ..... 271/288; 271/301; 271/302; 271/303; 271/186

(58) Field of Classification Search ..... 271/301–304, 271/225, 65, 186; 399/364
See application file for complete search history.

(56) References Cited

U.S. PATENT DOCUMENTS

| | | | | |
|---|---|---|---|---|
| 6,101,364 | A * | 8/2000 | Boehmer et al. | 399/361 |
| 6,107,579 | A | 8/2000 | Kinnemann | |
| 6,161,828 | A | 12/2000 | Sussmeier | |
| 6,419,222 | B1 * | 7/2002 | Morrison et al. | 271/186 |
| 6,450,711 | B1 * | 9/2002 | Conrow | 400/582 |
| 6,612,566 | B2 * | 9/2003 | Stoll | 271/186 |
| 7,093,831 | B2 | 8/2006 | Biegelsen et al. | |
| 7,305,200 | B2 | 12/2007 | Hoffman et al. | |
| 7,330,677 | B2 | 2/2008 | Ogura | |
| 7,426,043 | B2 | 9/2008 | Folkins | |
| 7,549,723 | B2 | 6/2009 | Mihara et al. | |
| 7,566,055 | B2 * | 7/2009 | Spencer et al. | 271/301 |
| 7,680,448 | B2 * | 3/2010 | Mandel et al. | 399/381 |
| 7,706,737 | B2 | 4/2010 | Lang | |
| 7,746,524 | B2 * | 6/2010 | Lofthus et al. | 358/498 |
| 7,811,017 | B2 * | 10/2010 | Spencer et al. | 400/624 |
| 7,912,416 | B2 * | 3/2011 | Mandel et al. | 399/381 |
| 7,946,582 | B2 * | 5/2011 | Suh | 271/302 |
| 7,963,518 | B2 * | 6/2011 | Moore | 271/65 |
| 2002/0066995 | A1 * | 6/2002 | Stoll | 271/186 |
| 2002/0070497 | A1 * | 6/2002 | Morrison et al. | 271/186 |
| 2003/0102624 | A1 * | 6/2003 | Stoll | 271/186 |
| 2004/0150158 | A1 * | 8/2004 | Biegelsen et al. | 271/303 |
| 2008/0196606 | A1 | 8/2008 | Lang | |
| 2009/0267285 | A1 * | 10/2009 | Willis | 271/3.14 |

OTHER PUBLICATIONS

Bober et al., U.S. Appl. No. 12/211,852, filed Sep. 17, 2008.
Bober et al., U.S. Appl. No. 12/211,853, filed Sep. 17, 2008.
Mandel et al., U.S. Appl. No. 12/331,768, filed Dec. 10, 2008. Suh et al., U.S. Appl. No. 12/413,802, Notice of Allowance, Apr. 4, 2011, 7 pages.
Suh et al., U.S. Appl. No. 12/413,802, Office Action Communication, Oct. 26, 2010, 10 pages.

* cited by examiner

*Primary Examiner* — Kaitlin Joerger
(74) *Attorney, Agent, or Firm* — Gibb I.P. Law Firm, LLC

(57) ABSTRACT

Disclosed is a sheet buffering and inverting device having a sheet transport path and multiple sheet inverter paths extending upward and/or downward there from. Sheets being transported through the sheet transport path are selectively diverted into the sheet inverter paths, held, and subsequently fed back into the sheet transport path such that they are inverted. Optionally, an additional sheet transport path can branch off the sheet transport path upstream of the sheet inverter paths and can connect to the distal end of each of the sheet inverter paths to allow sheets to be buffered without being inverted. This device can be incorporated into a discrete module of a modular printing system to ensure sheets are properly merged and oriented after processing by multiple printing engines. Alternatively, it can be incorporated into a standalone printing system to ensure sheets are properly buffered and/or inverted prior to processing by a single printing engine.

21 Claims, 12 Drawing Sheets

COMBINED SHEET BUFFER AND INVERTER

BACKGROUND AND SUMMARY

This application is related to the following co-pending applications filed concurrently herewith by the same Applicants and assigned to the same Assignee: "DOUBLE EFFICIENCY SHEET BUFFER MODULE AND MODULAR PRINTING SYSTEM WITH DOUBLE EFFICIENCY SHEET BUFFER MODULE" Ser. No. 12/413,802 and "SPACE EFFICIENT MULTI-SHEET BUFFER MODULE AND MODULAR PRINTING SYSTEM" Ser. No. 12/413,876. The complete disclosures of these co-pending applications are incorporated in their entirety herein by reference.

Embodiments herein generally relate to printing systems and, more particularly, to embodiments of a combined sheet buffering and inverting device that can be incorporated into a discrete module within a modular multi-marking engine printing system or into a standalone printing system.

Sheets being processed within a modular printing system may benefit from buffering and/or inverting after processing by multiple heterogeneous printing engines. For example, U.S. patent application Ser. No. 12/211,853 of Bober et al., filed on Sep. 17, 2008, and U.S. patent application Ser. No. 12/331,768 of Mandel et al., filed on Dec. 10, 2008 (both of which are assigned to Xerox Corporation of Norwalk, Conn., USA, and incorporated herein by reference in their entirety) both disclose electrostatographic printing systems comprising multiple modules (i.e., discrete interchangeable units). Each module comprises one or more of the printing system's functional components (e.g., sheet feeders, printing engines, finishers, etc.) structurally self-contained within its own supporting frame and housing (i.e., cabinet).

Oftentimes multi-page documents contain both single color (i.e., monochrome) pages and multi-color pages. Since it is more cost and time efficient to print single color pages using a single color (i.e., monochrome) printing engine vice a multi-color printing engine, modular printing systems incorporating heterogeneous printing engine modules (e.g., a single color and multi-color printing engine modules) in a tightly integrated parallel printing (TIPP) architecture have been developed (e.g., see U.S. patent application Ser. No. 12/211,853 of Bober et al. and U.S. patent application Ser. No. 12/331,768 of Mandel et al., incorporated by reference above). Such modular printing systems can print multi-page documents, having single color and multi-color pages in simplex and/or duplex format. To ensure that the various single color and multi-color pages are printed on print media sheets by the appropriate printing engine(s), a sorting process is performed.

Once printed, the single color and multi-color pages are merged back into a single stream in order to output the finished document. However, timing of sheet output from the different print engines to ensure proper page merging (i.e., to ensure that pages are in the proper order) presents a problem for a number of reasons. For example, since multi-color print engines are typically more costly to run and since multi-page documents typically have significantly more text-only pages than multi-color pages, it is more cost efficient to print all or batches of multi-color pages together. This minimizes the number of non-printing on-off and warm-up cycles performed by the multi-color printing engine during a single print job, but results in multi-color pages being printed out of order and, particularly, early. Timing of sheet output and also proper sheet orientation at output are further made difficult as a result of duplex printing and mixed printing (i.e., when a single sheet requires printing by one side by a single color printing engine and on the opposite side by a multi-color printing engine). Thus, it would be advantageous to provide a sheet buffering and inverting device that can be incorporated into a discrete module of a modular printing system in order to ensure sheets are properly merged and oriented after processing by multiple printing engines.

Sheets being processed within a standalone printing system may benefit from buffering and/or inverting prior to printing by a single printing engine. That is, sheets may need to be buffered (i.e., staged, temporarily held, etc.) until the printing engine is ready to receive them. Additionally, for duplex printing, sheets may need to be inverted prior to passing through the printing engine a second time. Thus, it would similarly be advantageous to provide a sheet buffering and inverting device that can be incorporated into a standalone printing system in order to ensure sheets are properly buffered and/or inverted prior to processing by a single printing engine.

In view of the foregoing disclosed herein are embodiments of a sheet buffering and inverting device. The device can each include a sheet transport path and multiple sheet inverter paths extending upward and/or downward from the sheet transport path. Selected sheets being transported through the sheet transport path can be diverted into the sheet inverter paths, can be held for a time (i.e., buffered, staged, etc.) in the sheet inverter paths, and can subsequently be fed back into the sheet transport path such that they are inverted. Optionally, additional sheet transport path(s) can branch off the sheet transport path upstream of the sheet inverter paths and can connect to the distal end of each sheet inverter path to allow sheets that do not require inverting to also be buffered. The device can be incorporated into a discrete module of a modular printing system in order to ensure sheets are properly merged and oriented after processing by multiple printing engines. Alternatively, the device can be incorporated into a standalone printing system in order to ensure sheets are properly buffered and/or inverted prior to processing by a single printing engine.

More particularly, embodiments of a sheet buffering and inverting device can comprise a sheet transport path extending, for example, essentially horizontally between a first location and a second location. The sheet transport path can receive a stream of sheets at the first location and can feed the stream of sheets towards the second location. Each of the sheets in the stream can initially (i.e., when received at the first location) have an orientation with a first edge comprising the leading edge and a second edge (i.e., the edge opposite the first edge) comprising the trailing edge.

A plurality of sheet inverter paths can be connected to the sheet transport path and can, for example, extend essentially vertically, downward and/or upward, from the sheet transport path. That is, each sheet inverter path can have a first end (i.e., a proximate end) adjacent and connected to the sheet transport path. Each sheet inverter path can further have a second end (i.e., a distal end) that is opposite the first end and, thus, that is located below or above, respectively, the sheet transport path. Each sheet inverter path can have a length sufficient to hold one or more print media sheets.

In one exemplary embodiment, the device can have multiple sheet inverter paths positioned either above the sheet transport path (i.e., upper sheet inverter paths) or below the sheet transport path (i.e., lower sheet inverter paths). In yet another exemplary embodiment, the device can have multiple upper sheet inverter paths positioned above the sheet transport path and multiple lower sheet inverter paths positioned below the sheet transport path. In yet another exemplary embodiment, the device can have a single upper sheet inverter path positioned above the sheet transport path and a single lower sheet inverter path positioned below the sheet transport path.

Additionally, each sheet inverter path can comprise a first gate, at least one sheet transport device, and a second gate. The first gate can divert a selected sheet from the stream being transported through the sheet transport path such that the first edge of the selected sheet enters the sheet inverter path rather than continuing along the sheet transport path. The sheet transport device can transport the selected sheet away from the sheet transport path at least until the second edge is fully contained within the sheet inverter path. The sheet inverter path can hold (i.e., buffer) the selected sheet. Subsequently, the sheet transport device can reverse directions, transporting the selected sheet back to the sheet transport path such it is inserted within the stream. This process can be guided by the second gate so that the orientation of the selected sheet is inverted, as compared to its original orientation within the stream (i.e., with the second edge comprising the leading edge and the first edge comprising the trailing edge).

Optionally, the sheet buffering and inverting device can further comprise one or more additional sheet transport path(s) branching from the sheet transport path upstream of the sheet inverter paths (i.e., between the first location and the sheet inverter paths). The additional sheet transport path(s) can connect to the distal end the sheet inverter paths to allow sheets that do not require inverting to also be held (i.e., buffered) in the sheet inverter paths. Finally, a controller that is operatively connected to the various sheet transport paths and sheet inverter paths and, more particularly, to the gates and sheet transport devices within such paths, can control sheet movement through the sheet transport paths and into and out of the sheet inverter paths.

Any of the sheet buffering and inverting device embodiments, as described above, can be incorporated into a discrete sheet buffering and inverting module. Such a sheet buffering and inverting module can comprise a frame having a first side and a second side opposite the first side. A sheet buffering and inverting device can be contained within and supported by the frame such that the sheet transport path extends essentially horizontally across the frame from a sheet input port on the first side to a sheet output port on the second side. Furthermore, one or more of these sheet buffering and inverting modules can be incorporated into a modular printing system, having multiple printing modules, in order to ensure that sheets printed by the multiple printing modules are properly merged and oriented prior to final output.

Any of the sheet buffering and inverting device embodiments, as described above, can also be incorporated a standalone printing system in order to ensure sheets are properly buffered and/or inverted prior to printing by a single printing engine. An exemplary stand alone printing system can comprise a printing engine (e.g., a xerographic printing engine, an inkjet printing engine, a solid ink printing engine, a bubble jet printing engine, etc.) and a sheet buffering and inverting device, as described above, adjacent to the printing engine.

For example, the sheet buffering and inverting device can comprise a sheet transport path extending from a first location to a printing engine and past the printing engine to a second location. The sheet transport path can further comprise a loop back connection back from the second location to the first location. A plurality of sheet inverter paths, each having a length sufficient to hold one or more print media sheets, can be positioned between the first location and the printing engine. Each of the sheet inverter paths can have a first end (i.e., a proximate end) adjacent to the sheet transport path and a second end (i.e., a distal end) opposite the first end. An additional sheet transport path can branch from the sheet transport path between the first location and the sheet inverter paths. This additional sheet transport path can connect to the distal end of each of the sheet inverter paths. A plurality of gates and sheet transport devices within the device can be selectively controllable so as to cause buffering and/or inverting of sheets by the sheet inverter paths prior to processing of the sheets by the printing engine. Specifically, a controller can be operatively connected to the gates and sheet transport devices and can control actuation of the gates and sheet transport devices in order to control movement of sheets into and out of the sheet inverter paths from either end and, thereby to cause buffering and/or inverting of the sheets, as necessary, prior to processing of the sheets by the printing engine.

These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

Figure 1:
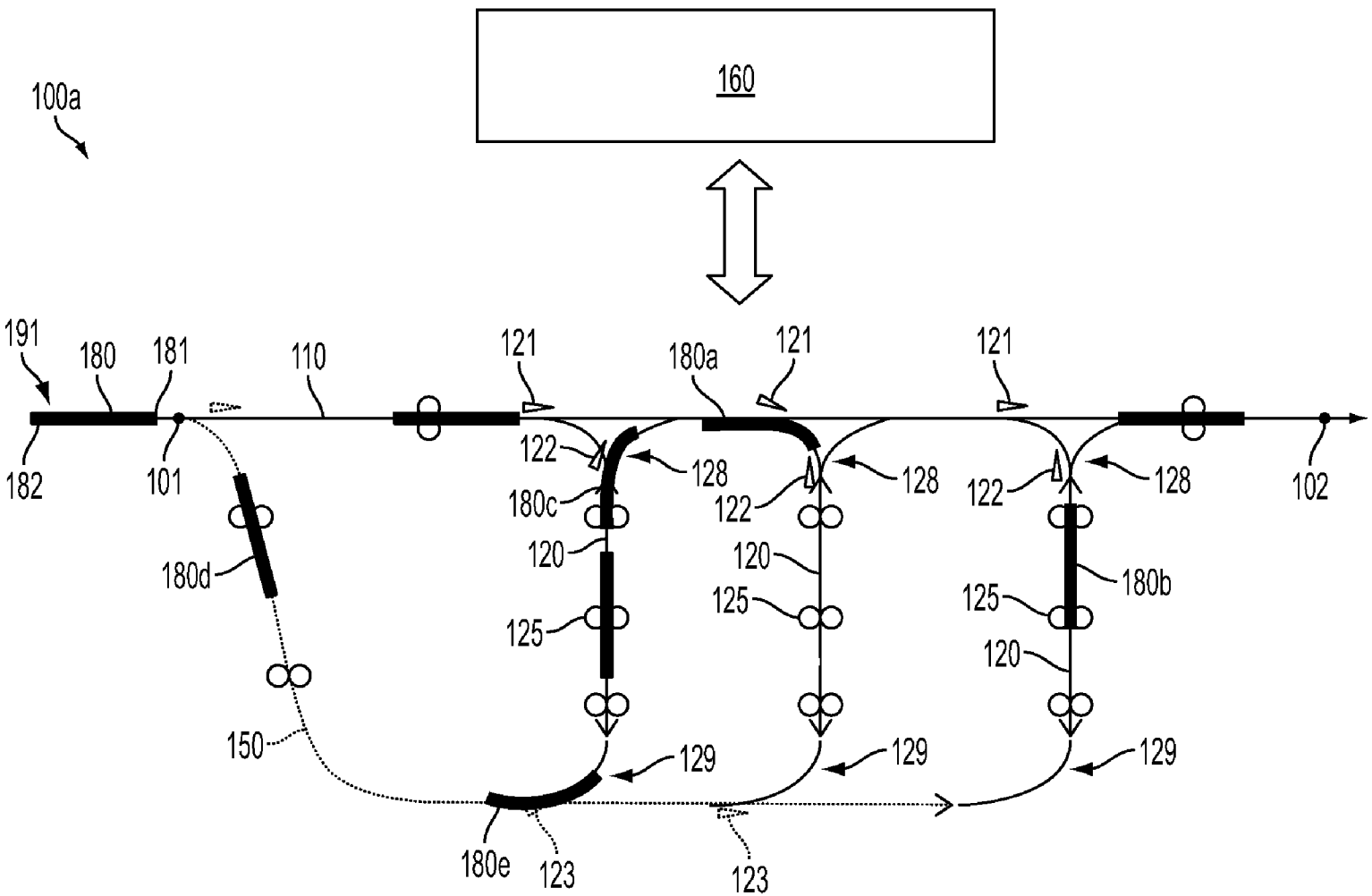
FIG. 1 is a schematic diagram of an embodiment of a sheet buffering and inverting device.

As mentioned above, sheets being processed within a modular printing system may benefit from buffering and/or inverting after processing by multiple heterogeneous printing engines. For example, U.S. patent application Ser. No. 12/211,853 of Bober et al., for a "RECONFIGURABEL SHEET TRANSPORT MODULE", filed on Sep. 17, 2008, and U.S. patent application Ser. No. 12/331,768 of Mandel et al., for a "MODULAR PRINTING SYSTEM", filed on Dec. 10, 2008 (both of which are assigned to Xerox Corporation of Norwalk, Conn., USA, and incorporated herein by reference in their entirety) both disclose electrostatographic printing systems comprising multiple modules (i.e., discrete interchangeable units). Each module comprises one or more of the printing system's functional components (e.g., sheet feeders, printing engines, finishers, etc.) structurally self-contained within its own supporting frame and housing (i.e., cabinet).

Oftentimes multi-page documents contain both single color (i.e., monochrome) pages and multi-color pages. Since it is more cost and time efficient to print single color pages using a single color (i.e., monochrome) printing engine vice a multi-color printing engine, modular printing systems incorporating heterogeneous printing engine modules (e.g., a single color and multi-color printing engine modules) in a tightly integrated parallel printing (TIPP) architecture have been developed (e.g., see U.S. patent application Ser. No. 12/211,853 of Bober et al. and U.S. patent application Ser. No. 12/331,768 of Mandel et al., incorporated by reference above). Such modular printing systems can print multi-page documents, having single color and multi-color pages in simplex and/or duplex format. To ensure that the various single color and multi-color pages are printed on print media sheets by the appropriate printing engine(s), a sorting process is performed.

Once printed, the single color and multi-color pages are merged into a single stream in order to output the finished document. However, timing of sheet output from the different print engines to ensure proper page merging (i.e., to ensure that pages are in the proper order) presents a problem for a number of reasons. For example, since multi-color print engines are typically more costly to run and since multi-page documents typically have significantly more text-only pages than multi-color pages, it is more cost efficient to print all or batches of multi-color pages together. This minimizes the number of on-off and warm-up cycles performed by the multi-color printing engine during a single print job, but results in multi-color pages being printed out of order and, particularly, early. Timing of sheet output and also proper sheet orientation at output are further made difficult as a result of duplex printing and mixed printing (i.e., when a single sheet requires printing by one side by a single color printing engine and on the opposite side by a multi-color printing engine). Thus, it would be advantageous to provide a sheet buffering and inverting device that can be incorporated into a discrete module of a modular printing system in order to ensure that sheets are properly merged and oriented after processing by multiple printing engines.

Also, as mentioned above, sheets being processed within a standalone printing system may benefit from buffering and/or inverting prior to printing by a single printing engine. For example, in the printing architecture, such as that disclosed in U.S. Pat. No. 7,305,200 of issued to Hoffman et al. on Dec. 4, 2007, assigned to Xerox Corporation, Norwalk, Conn., and incorporated herein by reference, sheets may require buffering or staging within a staging area prior to passing through a printing engine. That is, some quantity of sheets may need to be temporarily held until the printing engine is ready to receive them. Additionally, for duplex printing sheet inverting is also required. Thus, it would similarly be advantageous to provide a sheet buffering and inverting device that can be incorporated into a standalone printing system in order to ensure that sheets are properly buffered and/or inverted prior to printing by a single printing engine.

In view of the foregoing disclosed herein are embodiments of a sheet buffering and inverting device. The device includes a sheet transport path and multiple sheet inverter paths extending upward and/or downward from the sheet transport path. Selected sheets being transported through the sheet transport path can be diverted into the sheet inverter paths, can be held (i.e., buffered) in the sheet inverter paths, and can subsequently be fed back into the sheet transport path such that they are inverted. Optionally, additional sheet transport path(s) can branch off the sheet transport path upstream of the sheet inverter paths and can connect to the distal end of each sheet inverter path to allow sheets that do not require inverting to also be buffered. Each of the device embodiments can be incorporated into a discrete module of a modular printing system in order to ensure sheets are properly merged and oriented after processing by multiple printing engines. Alternatively, the device embodiments can be incorporated into a standalone printing system in order to ensure sheets are properly buffered and/or inverted prior to processing by a single printing engine.

Figure 2:
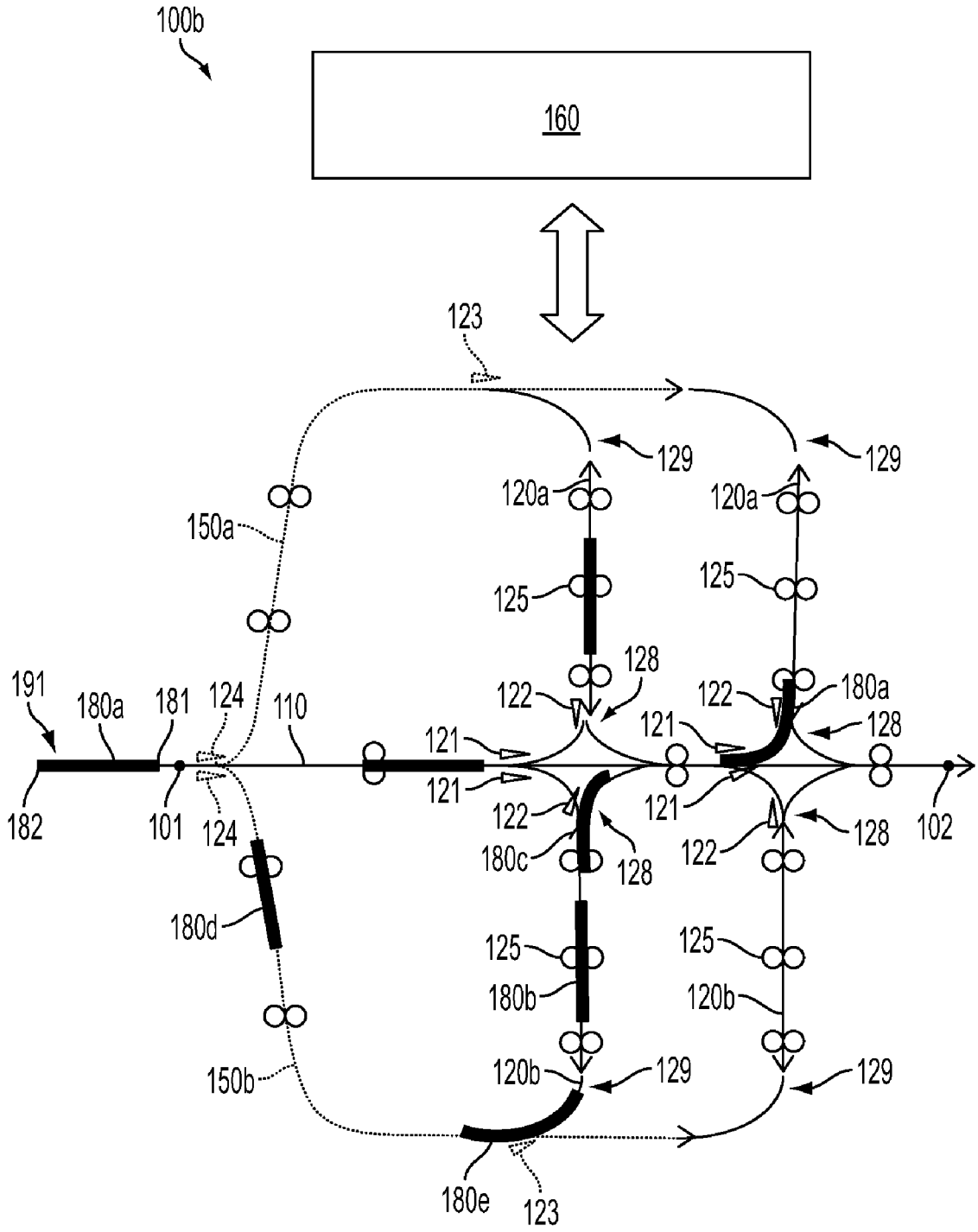
FIG. 2 is a schematic diagram of another embodiment of a sheet a buffering and inverting device.
Figure 3:
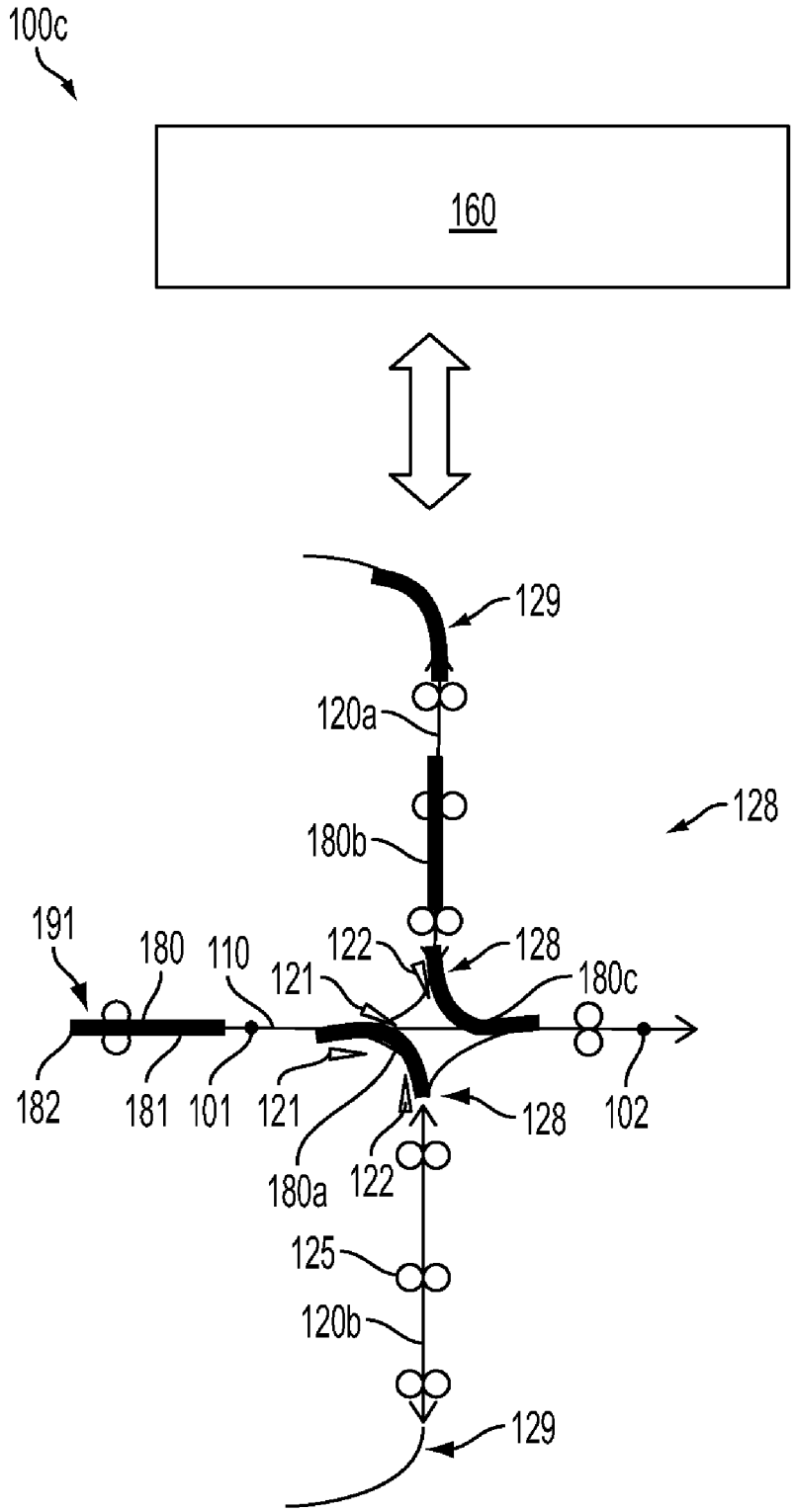
FIG. 3 is a schematic diagram of yet another embodiment of a sheet a buffering and inverting device.

More particularly, referring to FIGS. 1-3, various embodiments of a sheet buffering and inverting device 100*a*, 100*b*, 100*c* each comprise a sheet transport path 110 extending, for example, essentially horizontally between a first location 101 and a second location 102. The sheet transport path 110 can receive a stream 191 of print media sheets 180 at the first location 101 (e.g., from a location adjacent to a sheet input port or other sheet source) and can feed the stream 191 of sheets 180 towards the second location 102 (e.g., toward a location adjacent a sheet output port or sheet stacker). To accomplish this the sheet transport path 110 can comprise multiple conventional sheet transport devices 125 (e.g., nip apparatuses, as shown, or transport belts) that are configured (e.g., with drive rollers) to cause print media sheets 180 entering the sheet transport path 110 at the first location 101 to be transported toward the second location 102. Each of the sheets 180 in the stream 191 can initially (i.e., when received at the first location 101) have an orientation with a first edge 181 comprising the leading edge and a second edge 182 (i.e., the edge opposite the first edge) comprising the trailing edge.

A plurality of sheet inverter paths 120 can be connected to the sheet transport path 110 and can, for example, extend essentially vertically, downward and/or upward, from the sheet transport path 110. That is, each sheet inverter path 120 can have a first end 128 (i.e., a proximate end) adjacent and connected to the sheet transport path 110. Each sheet inverter path 120 can have a second end 129 (i.e., a distal end) that is opposite the first end and, thus, that is located below or above, respectively, the sheet transport path 110.

In one exemplary embodiment, as illustrated in FIG. 1, the device 100*a* can have multiple sheet inverter paths 120 positioned either above the sheet transport path (i.e., upper sheet inverter paths) or below the sheet transport path 110 (i.e., lower sheet inverter paths, as shown). In yet another exemplary embodiment, as illustrated in FIG. 2, the device 100*b* can have multiple upper sheet inverter paths 120*a* positioned above the sheet transport path 110 and multiple lower sheet inverter paths 120*b* positioned below the sheet transport path 110. In yet another exemplary embodiment, as illustrated in FIG. 3, the device 100*c* can have a single upper sheet inverter path 120*a* positioned above the sheet transport path 110 and a single lower sheet inverter path 120 positioned below the sheet transport path 110.

Regardless of the embodiment, each sheet inverter path 120 can have a length sufficient to hold one or more print media sheets 180 (e.g., three letter sized sheets (i.e., 8½×11 inch sheets), two 13×19 inch sheets, etc.). Additionally, in the embodiments 100*b*-100*c* illustrated in FIGS. 2-3, respectively, which have one or more upper sheet inverter paths 120*a* and one or more lower sheet inverter paths 120*b*, the upper and lower sheet inverter paths 120*a* and 120*b* may have different lengths and thereby, different buffering capacities.

Additionally, each sheet inverter path 120 can comprise a first gate 121, at least one sheet transport device 125, and a second gate 122. Each first gate 121 can be positioned at the proximate end 128 of a corresponding sheet inverter path 120 adjacent to the sheet transport path 110. Each first gate 121 can divert a selected print media sheet from the stream 191 into its corresponding sheet inverter path 120 such that its first edge enters the sheet inverter path 120 (e.g., see sheet 180*a*). A sheet transport device 125 within the sheet inverter path 120 can then cause the selected sheet to be transported away from the sheet transport path 110 at least until the second edge of the print media sheet enters the path 120 such that the selected sheet is fully contained within the sheet inverter path 120. The sheet inverter path 120 can hold (i.e., buffer) the selected sheet within the sheet inverter path 120 (e.g., see sheet 180*b*), as necessary. Subsequently, the sheet transport device 125 can reverse directions and, thereby transport the selected sheet back to the sheet transport path 110 such that the selected sheet is inserted within the stream 191 (e.g., see sheet 180*c*). This process can be guided by the second gate 122 so that the orientation of the selected sheet, which entered the sheet inverter path 110 from the proximate end 128, is inverted, as compared to its original orientation within the stream 191 (i.e., such that the second edge now comprises the leading edge and the first edge comprises the trailing edge). Insertion of these buffered and inverted sheets back into the stream 191 can, for example, be timed to ensure that sheets passing through the second location 102 are in a particular order. Alternatively, buffered and inverted sheets can be inserted back into the stream 191 when a downstream processing unit (e.g., a printing engine) is determined to be ready to receive the sheets.

Optionally, the sheet buffering and inverting device can further comprise at least one additional sheet transport path to allow for sheet buffering without sheet inverting. For example, the device 100*a* of FIG. 1 can comprise an optional additional sheet transport path 150 that branches from the main sheet transport path 110 upstream of the sheet inverter paths 120 (i.e., between the first location 101 and the sheet inverter paths 120). The additional sheet transport path 150 can connect to the distal end 129 of the sheet inverter paths. Similarly, in the device 100*b* of FIG. 2, an optional lower additional sheet transport path 150*b* can branch from the main sheet transport path 110 upstream of the sheet inverter paths 120*a-b* (i.e., between the first location 101 and the sheet inverter paths 120*a-b*) and can connect to the distal end 129 of each lower sheet inverter path 120*b* and/or an optional upper additional sheet transport path 150*a* can branch from the main sheet transport path 110 upstream of the sheet inverter paths 120*a-b* (i.e., between the first location 101 and the sheet inverter paths 120*a-b*) and can connect to the distal end 129 of each upper sheet inverter path 120*a*.

Referring to FIG. 1 (and similarly to FIG. 2), each additional sheet transport path 150 can have an additional gate 124 that diverts sheets and, more particularly, sheet which require buffering but not inverting, away from the sheet transport path 110 (e.g., see sheet 180*d*). The sheet inverter paths 120 can further comprise third gates 123 at their distal ends 129 for further diverting such sheets from the additional sheet transport path into a corresponding sheet inverter path. The sheet inverter paths 120 can hold (i.e., buffer) such sheets and, after the required buffering, can transport the sheets to the sheet transport path 110 such that they are inserted within the stream 191 without being inverted. As with the buffered and inverted sheets, insertion of the buffered only sheets back into the stream 191 can be timed to ensure that sheets passing through the second location 102 are in a particular order. Alternatively, the buffered only sheets can be inserted back into the stream 191 when a downstream processing unit (e.g., a printing engine) is determined to be ready to receive the sheets. In addition to allowing for sheet buffering without sheet inverting, such additional sheet transport path(s) further avoid sheet interference issues that can occur within the device, if any single sheet inverter path 120 needs to be filled and emptied at the same time.

In each of the device embodiments, as illustrated in FIGS. 1-3, a controller 160 can be operatively connected to the various sheet transport and buffer paths 110, 120 and 150 and, more particularly, to gates (e.g., gates 121-124) and sheet transport devices 125 within such paths 110, 120 and 150 in order to control sheet movement through the device. Specifically, each gate 121-124 can be configured as a baffle or diverter capable of pivoting movement in order to control and alter, as necessary, the direction a sheet travels The pivoting movement of each gate 121-124 can be individually and selectively controlled by the controller 160. For example, the pivoting movement of each gate 121 can be selectively controlled by the controller 160 to either allow sheets to pass along the sheet transport path 110 directly to the second location 102 or to force sheets to divert into (i.e., enter into) a corresponding sheet inverter path 120 on demand. The pivoting movement of each gate 122 can be selectively controlled to guide a sheet back into the sheet transport path 110 from a corresponding sheet inverter path 120 on demand. The pivoting movement of gates 124 and 123 can similarly be selectively controlled by the controller 160 to ensure that any sheets, which require buffering but not inverting, are diverted from the sheet transport path 110, into an additional sheet transport path 150 and further into a sheet inverter path 120.

Additionally, each sheet transport device 125 can be configured with a drive roller, which rotates so as to directly (e.g., in the case of nip apparatuses) or indirectly (e.g., in the case of transport belts) cause a sheet to move in a given direction. Within the sheet inverter paths 120, each sheet transport device 125 can particularly be configured with a bi-directional drive roller (i.e., a drive roller capable of reversing its direction of rotation) so as to allow the direction of travel of sheets within any given sheet inverter path 120 to be reversed on demand. Rotation of each drive roller can be controlled by a motor, which in turn can be individually and automatically controlled by the controller 160 to cause sheets to enter the sheet inverter paths 120 from either the proximate or distal ends 128-129 on demand, to allow sheets to be buffered by the sheet inverter paths 120 (e.g., for a predetermined period of time) and to force buffered sheets to exit the sheet inverter path 120 on demand (e.g., at the end of the predetermined period of time) and thereby, to reenter the sheet transport path 110 on demand, as described above.

Thus, actuation of each gate 121-124 and each sheet transport device 125 can be individually and selectively controlled (e.g., by the controller 160) to guide selected sheets into and out of sheet inverter paths 120 from either the sheet transport path 110 at the proximate end 128 or an optional additional sheet transport path at the distal end 129 in order to provide any required sheet buffering and/or sheet inverting. It should be understood that the sheet transport path 110 provides a through path that allows any sheets that do not need to be buffered or inverted, as determined by the controller 160, to pass freely between the first location 101 and the second location. It should further be understood that in order to avoid conflicts when scheduling which sheets need to be buffered and/or inverted and which of the sheet buffering paths 120 will perform such buffering and/or inverting, either individually or simultaneously, the controller 160 must consider what order the sheets 180 should be in as the stream 191 passes the second location 102. For example, if sheet A and then sheet B enter the same sheet inverter path from the proximate end 128, they will necessarily exit the sheet inverter path 120 in a first-in, last-out (FILO) order (i.e., B and then A). Thus, the controller 160 will only schedule sheets A and B to be simultaneously buffered by the same sheet inverter path, if sheet B is suppose to arrive at location 102 prior to sheet A.

Figure 4:
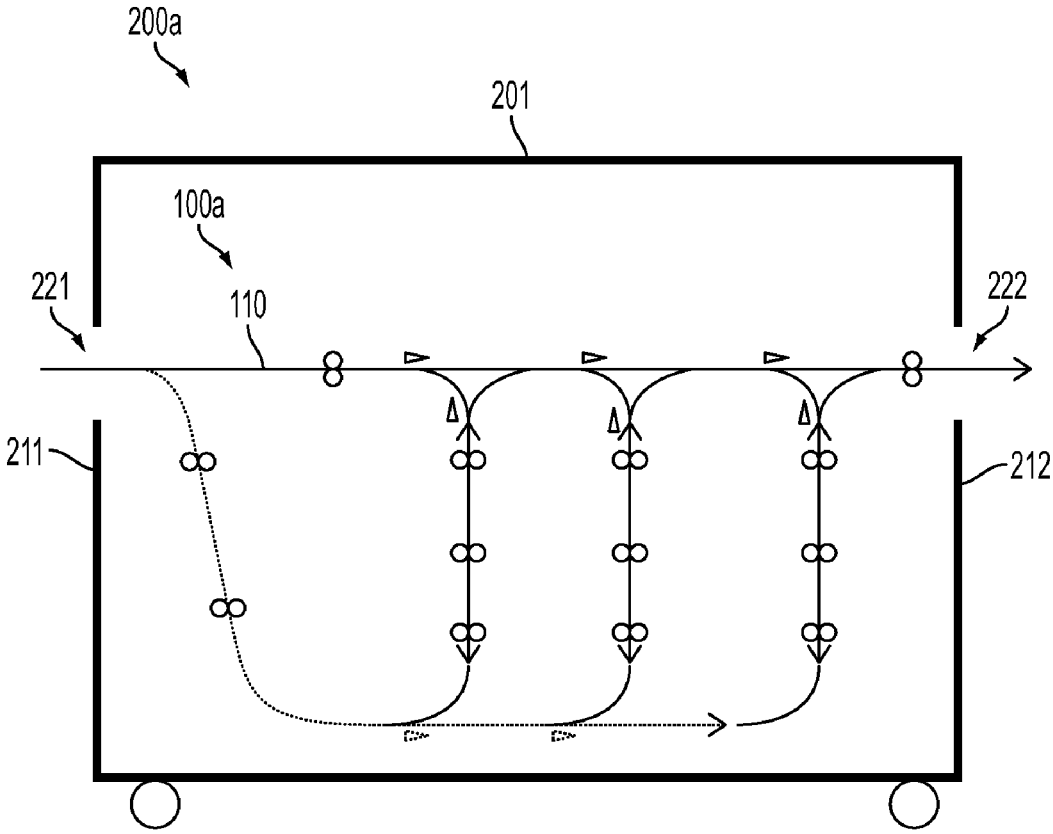
FIG. 4 is a schematic diagram illustrating a discrete module incorporating the device of FIG. 1.
Figure 5:
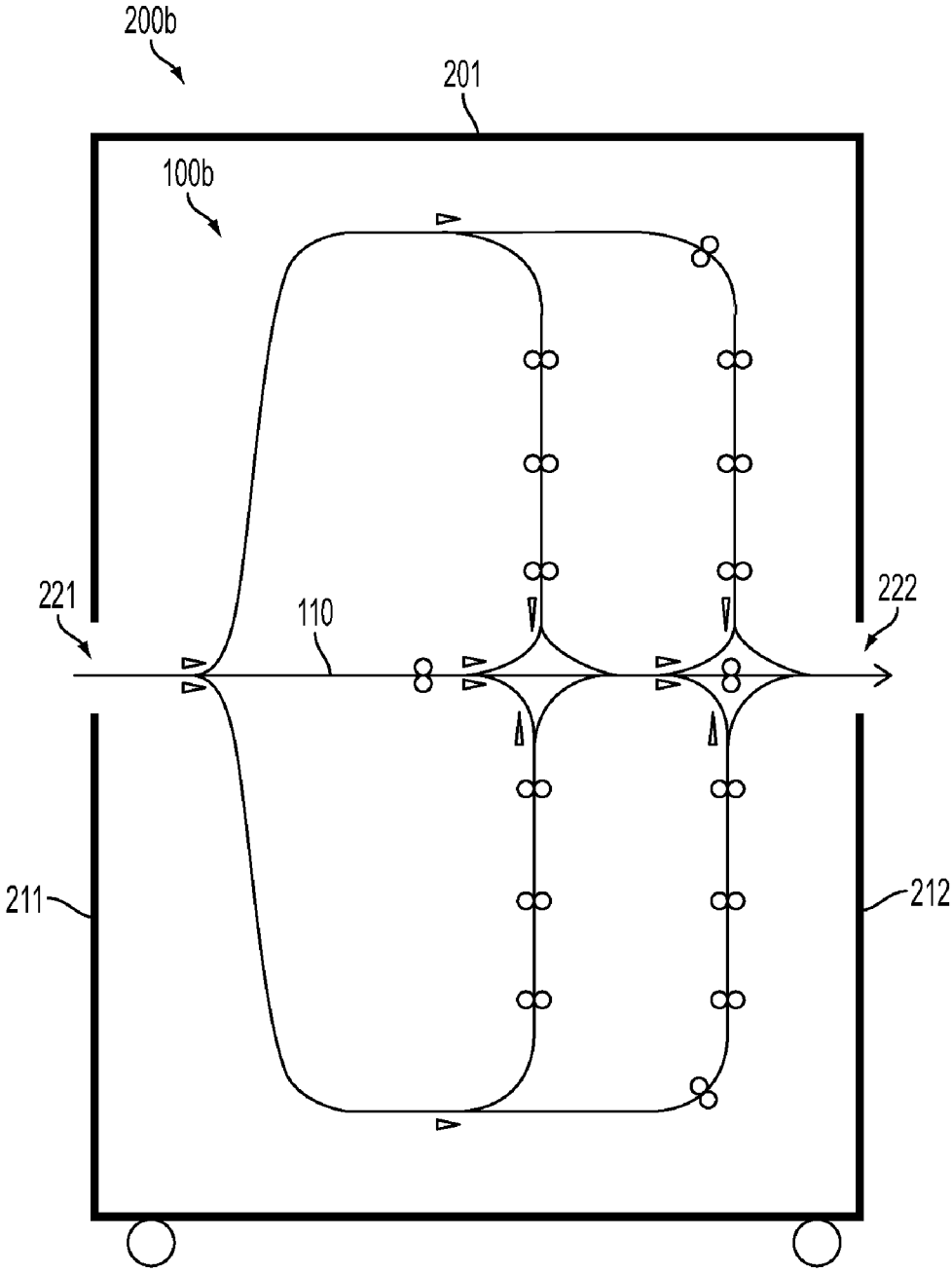
FIG. 5 is a schematic diagram illustrating a discrete module incorporating the device of FIG. 2.

Any of the above-described sheet buffering and inverting device embodiments can be incorporated into a discrete sheet buffering and inverting module of a modular printing system. For example, FIG. 4 illustrates the device 100*a* of FIG. 1 incorporated into a sheet buffering and inverting module 200*a*. FIG. 5 illustrates the device 100*b* of FIG. 2 incorporated into a sheet buffering and inverting module 200*b*. It should be noted that the sheet buffering and inverting module 200*b* of FIG. 5 is similar in structure to the sheet buffering module 100 of FIG. 1 of the co-pending related patent application for a "DOUBLE EFFICIENCY SHEET BUFFER MODULE AND MODULAR PRINTING SYSTEM WITH DOUBLE EFFICIENCY SHEET BUFFER MODULE" Ser. No. 12/413,802, incorporated by reference above, but has the added sheet inverting capability. Finally, FIG. 6 illustrates the device 100*c* of FIG. 3 incorporated into a sheet buffering and inverting module 200*c*.

Each of these sheet buffering and inverting modules 200*a*, 200*b* and 200*c* comprise a frame 201 having a first side 211 and a second side 212 opposite the first side 211. The sheet buffering and inverting device (i.e., 100*a*, 100*b* or 100*c*, respectively) can be contained within and supported by the frame 201 such that the sheet transport path 110 extends essentially horizontally across the frame 201 from a sheet input port 221 on the first side 211 to a sheet output port 222 on the second side 212.

Figure 6:
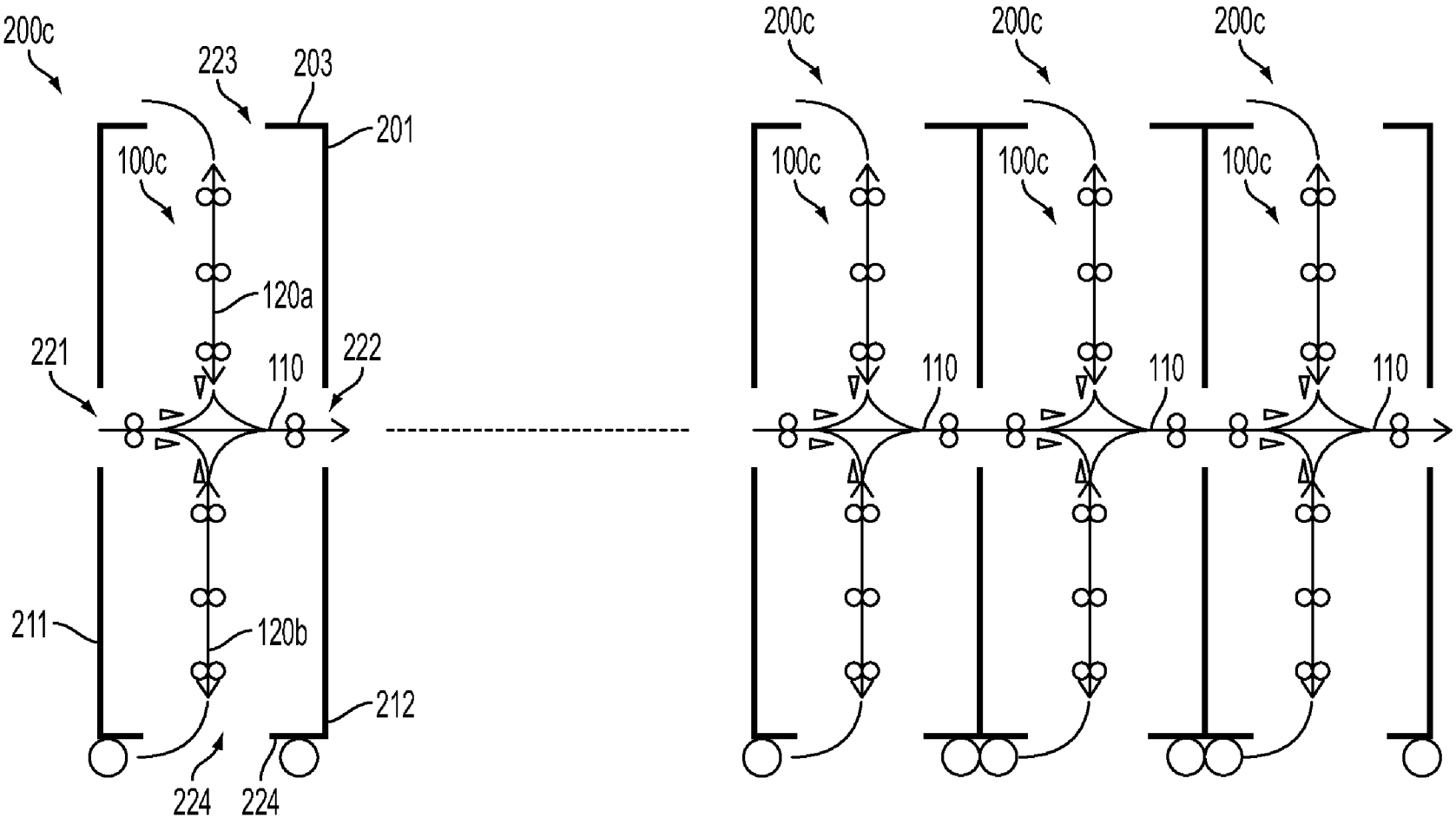
FIG. 6 is a schematic diagram illustrating multiple discrete modules incorporating the device of FIG. 3.

Additionally, as illustrated particularly with respect to the module 200*c* of FIG. 6 but contemplated with respect to any of the other modules 200*a-b*, the top and/or bottom surfaces 203, 204 of the frame 200 may have openings 223, 224 to allow sheets to extend beyond the frame 200. This configuration would be advantageous if a single sheet contained in the sheet inverter path 120*a* or 120*b* is longer than the sheet inverter path 120*a* or 120*b* or when the combined length of multiple sheets contained within the sheet inverter path 120*a* or 120*b* is longer than the sheet inverter path 120*a* or 120*b*. Furthermore, also as illustrated particularly with respect to the module 200*c* of FIG. 6, but contemplated with respect to any of the other modules 200*a-b*, multiple modules may be positioned in series to allow for customized buffering capacity (i.e., to allow the number of sheets that can be buffered simultaneously to be varied depending upon customer needs). For example, a customer can purchase only the number of modules required to achieve a given buffering capacity and may upgrade (i.e., add additional modules) as their needs change.

It should be noted that the series connected sheet buffering and inverting modules 200*c* illustrated in FIG. 6 provide a low cost increased capacity option over traditional sheet buffering modules. This is because each module 200*c* limits the number of inverter paths 120 to two and doesn't include the optional additional transport path(s). Thus, each module 200*c* only requires one set of drive rollers per sheet inverter path 120*a*-120*b*. Furthermore, due to the limited number of sheet inverter paths per module, the frame 201 can be made using lighter, less expensive, construction materials than that used in traditional buffer modules. By incorporating such small, inexpensive modules into a modular printing system and only using the minimum number of modules required by the printing system to achieve the desired buffering capacity, the overall cost and footprint of the printing system can be minimized.

Figure 7:
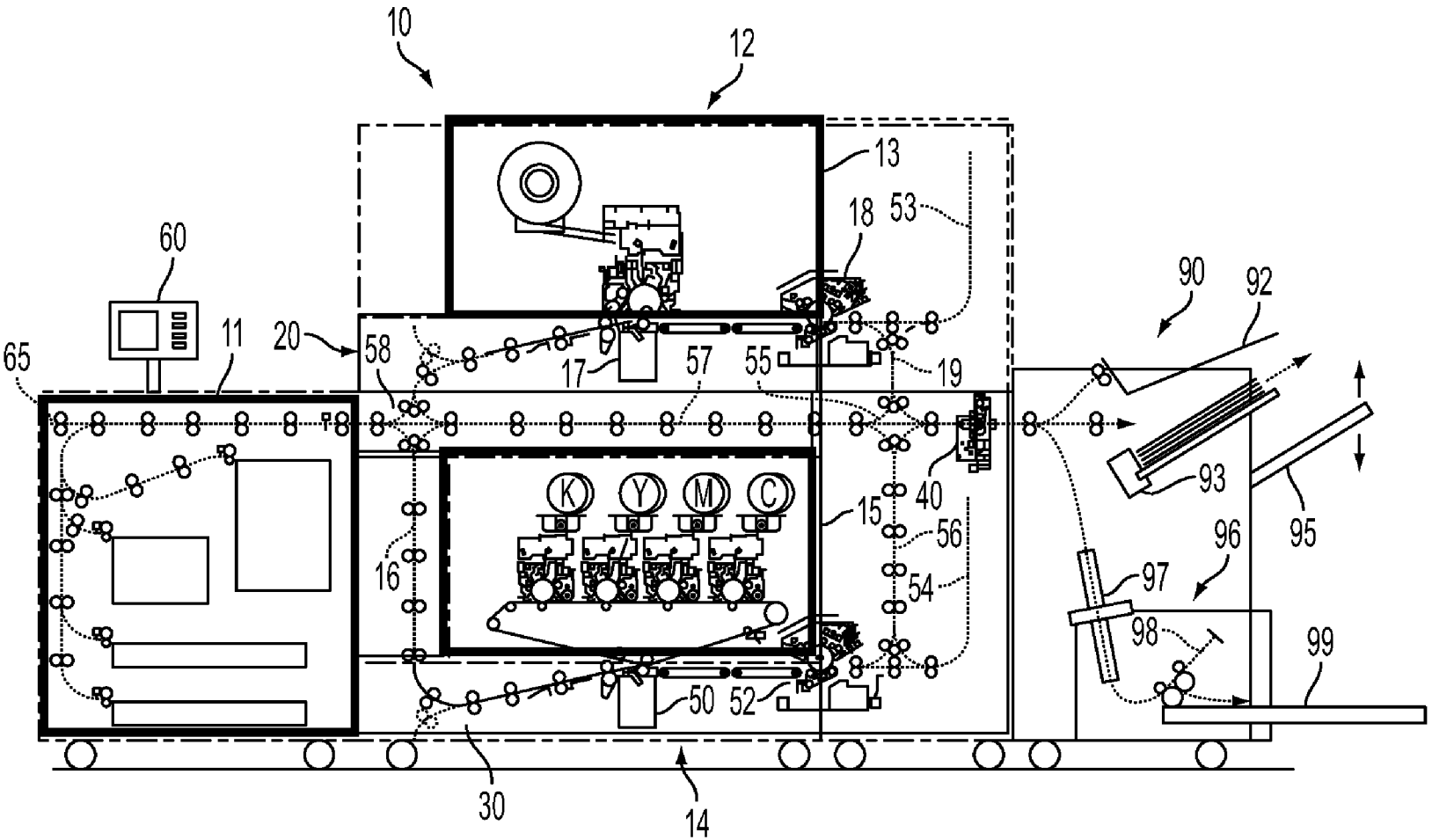
FIG. 7 is a schematic diagram illustrating an exemplary modular multi-marking engine printing system.

As mentioned above, modular printing systems may require or benefit from sheet buffering and/or inverting in order to output a multi-page document with all pages in the proper order and orientation. Specifically, U.S. patent application Ser. No. 12/211,853 of Bober et al. (incorporated by reference above) discloses a modular printing system 10, as illustrated in FIG. 7, that provides for single color printing in simplex or duplex format, multi-color printing in simplex or duplex format and mixed printing (i.e., printing on one side of a sheet using a single color printing engine and on the opposite side of the same sheet using a multi-color printing engine). This modular printing system 10 outputs a merged stream of single color sheets in simplex or duplex format, multi-color sheets in simplex or duplex format and, optionally, mixed sheets (i.e., sheets printed on one side with a single color and on the opposite side with multiple colors) into a finisher module 90 and would benefit the incorporation of a sheet buffer module capable of re-ordering sheets from the merged stream and an inverter module capable of re-orienting sheets, as necessary, prior to processing by the finisher module 90. The modular printing system 10 comprises a sheet feed module 11, first and second electronic printers 12 and 14 that include a conventional monochrome marking engine module 13 and a conventional color image marking engine module (IME) 15, respectively, and a paper transport path leading into and out of each printer that includes media path modules 20 and 30 connecting these three modules and associated for tightly integrated parallel printing of documents with the system. Finished output from the printing system is sent to a conventional finisher 90.

For simplex monochrome copies, feeder module 11 includes a plurality of conventional sheet feeders that feed sheets into a media path highway 57 and into a conventional diverter gate system 58 that conveys the sheets into upper media path module 20 and on to transfer station 17 to have images from IME 13 transferred thereto. The sheets are then transported through fuser 18 and into inverter 53 where the sheet is inverter for proper face down output collation exiting to the vertical path 19, through a diverter gate system 53, decurler 40 and into finisher 90. Alternatingly, unimaged sheets from sheet feed module 11 are fed downward through the diverter gate system 58 into vertical transport 16 and through lower media path module 30 to transfer station 50 to receive images from IME 15. The sheets are then transported through fuser 52, into inverter 54 for proper face down output collation, exiting into vertical transport 56, through diverter gate system 55 and through decurler 40 en route to conventional finisher 90 accepts unstapled sheets in upper catch tray 92 or stapled sheet at 93 in intermediate catch tray 95 or sheets stapled at 97 in booklet maker 96 and folded into booklets at folder 98 and outputted onto lower catch tray 99. Control station 60 allows an operator to selectively control the details of a desired job. Optionally, an insert or interposed sheet, such as, a cover, photo, tab sheet or other special sheet can be inserted into the first printer engine from an auxiliary sheet feed source (not shown) through sheet input 65, if desired.

For color image duplexing, sheets can be fed from feeder module 11 through diverter system 58, into color electronic printer 14 and downward along vertical transport 16 to lower media path module 30 and on to transfer station 50 to receive images on a first side thereof from IME 15 that includes cyan, magenta, yellow and black developer housings. Afterwards, the sheets are forwarded through fuser 52 and into inverter 54. The sheets leave inverter 54 trail edge first and are fed upwards along media transport path 56 and into media path highway 57, through diverter gate systems 55 and 58 and eventually downward along vertical transport 16 and back to lower media path module 30 and again through transfer station 50 to receive images onto a second side of the sheets. The sheets are then fused at fuser 52 and transported upward along media path 56, through diverter gate system 55 and out through decurler 40 and into finisher 90. For monochrome image duplexing, sheets can be fed from feeder module 11 through diverter gate system 58, into monochrome electronic printer 12 and into the media path module 20 and on to transfer station 17 to receive monochrome images on a first side thereof from IME 13 that includes a black developer housing only. Afterwards, the sheets are forwarded through fuser 18 and into inverter 53. The sheets leave inverter 53 trail edge first and are fed downwards along media transport path 19, through diverter gate system 55 and into media path highway 57, through diverter gate system 58 and back to upper media path module 20 and again through transfer station 17 to receive monochrome images onto a second side of the sheets. The sheets are then fused at fuser 18 and transported downward along media path 19, through diverter gate system 55 and out through decurler 40 and into finisher 90. Or alternatingly, combinations of one side monochrome and one side color imaged duplexed sheets can be produced by using these same media path elements in the appropriate sequences.

Any one of the sheet buffering and inverting modules 200*a-c* described in detail above and illustrated in FIGS. 4-6 can be incorporated into a modular printing system 10 such as that illustrated in FIG. 7. For example, the modular printing system 10 illustrated in FIG. 8 incorporates the sheet buffering and inverting module 200*a* of FIG. 4, which as discussed in detail above contains the sheet buffering and inverting device 100*a* of FIG. 1. The modular printing system 10 of FIG. 9 incorporates the sheet buffering and inverting module 200*b* of FIG. 5, which as discussed in detail above contains the sheet buffering and inverting device 100*b* of FIG. 2. The modular printing system 10 illustrated in FIG. 10 incorporates the multiple sheet buffering and inverting modules 200*c* connected in series for customized buffering capacity. As illustrated in FIG. 6, this module 200*c* incorporates the sheet buffering and inverting device 100*c* of FIG. 3.

Figure 8:
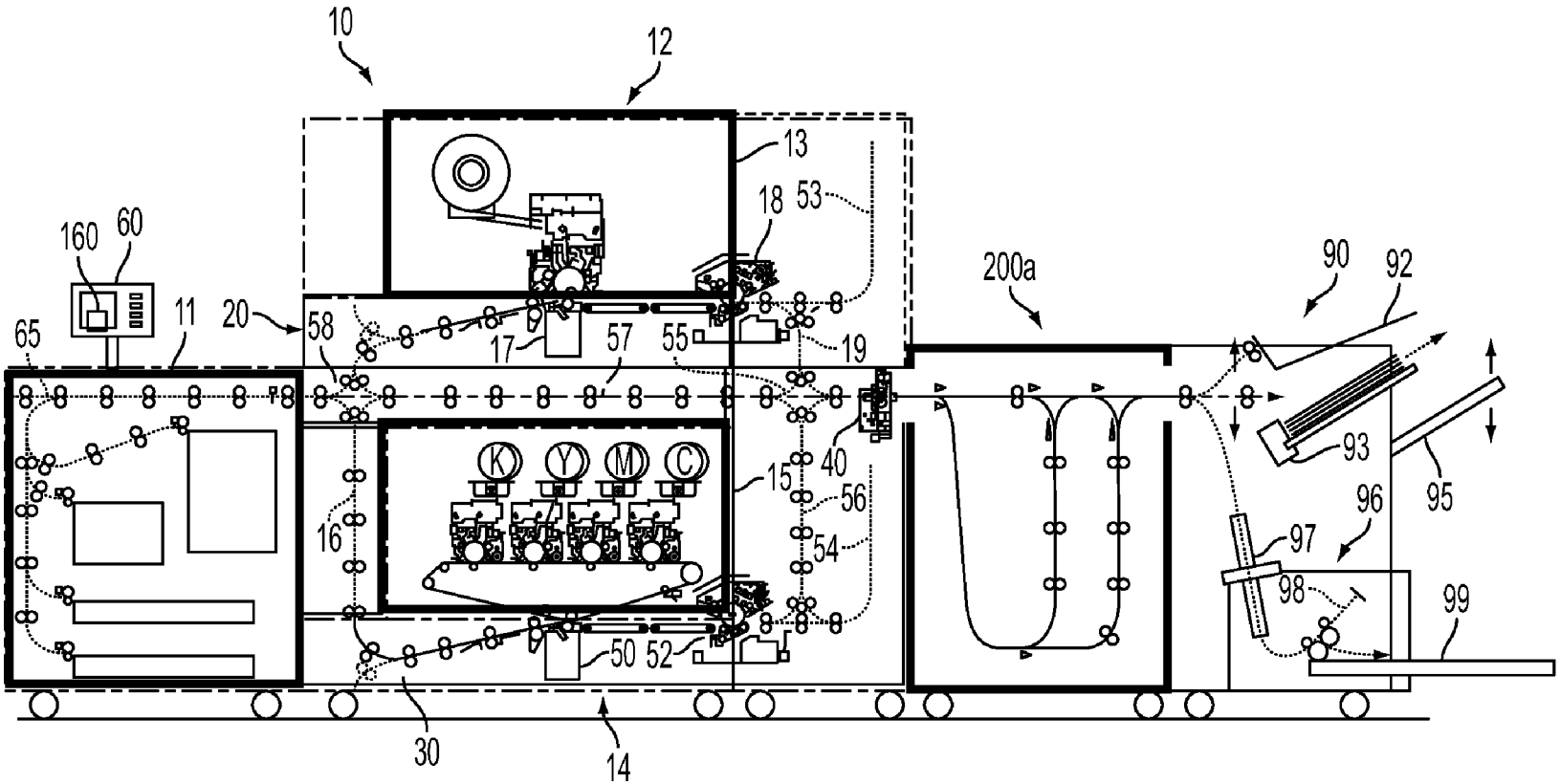
FIG. 8 is a schematic diagram illustrating a modular multi-marking engine printing system incorporating the discrete module of FIG. 4 and, thus, the device of FIG. 1.
Figure 9:
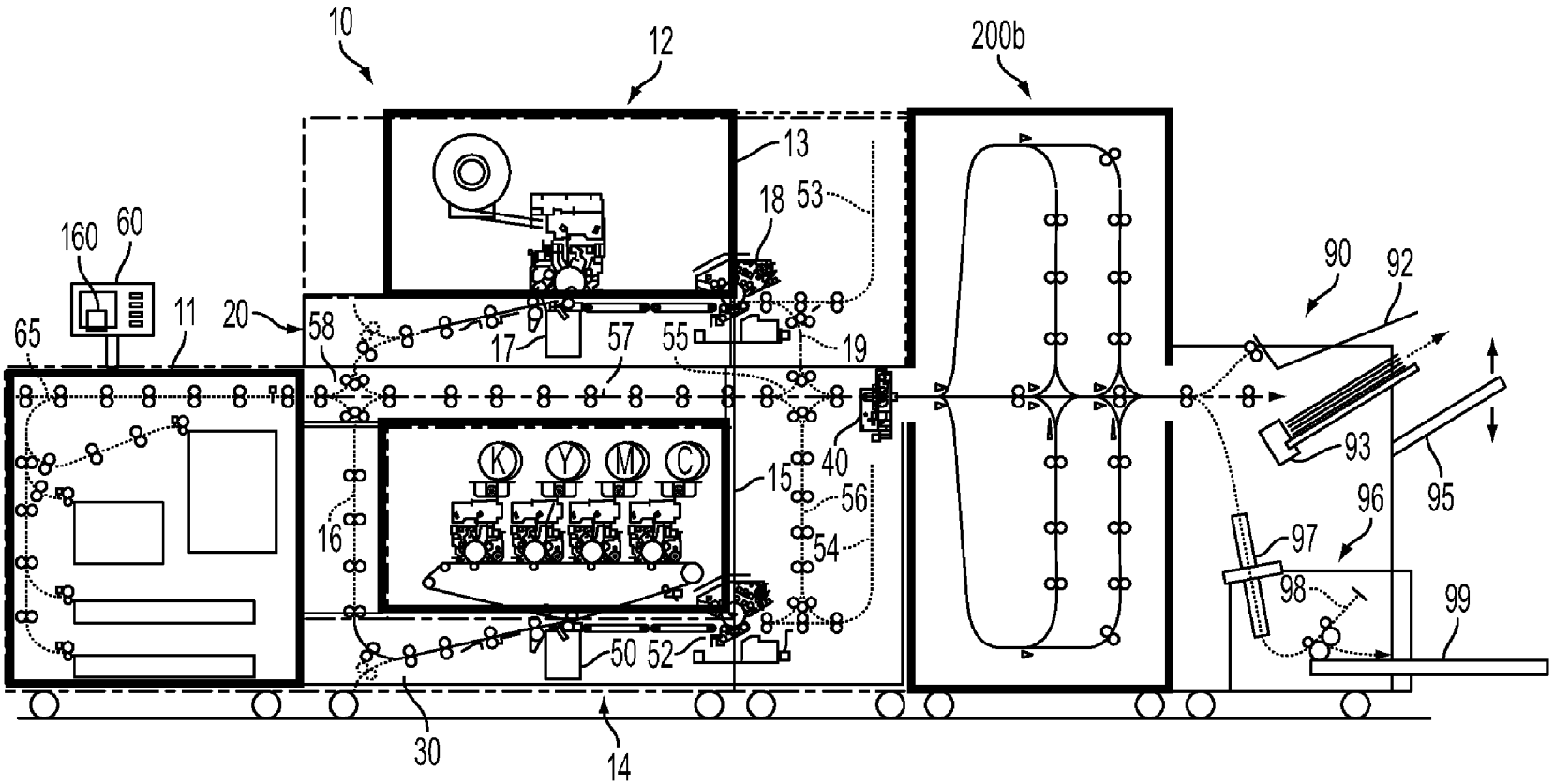
FIG. 9 is a schematic diagram illustrating a modular multi-marking engine printing system incorporating the discrete module of FIG. 5 and, thus, the device of FIG. 2.
Figure 10:
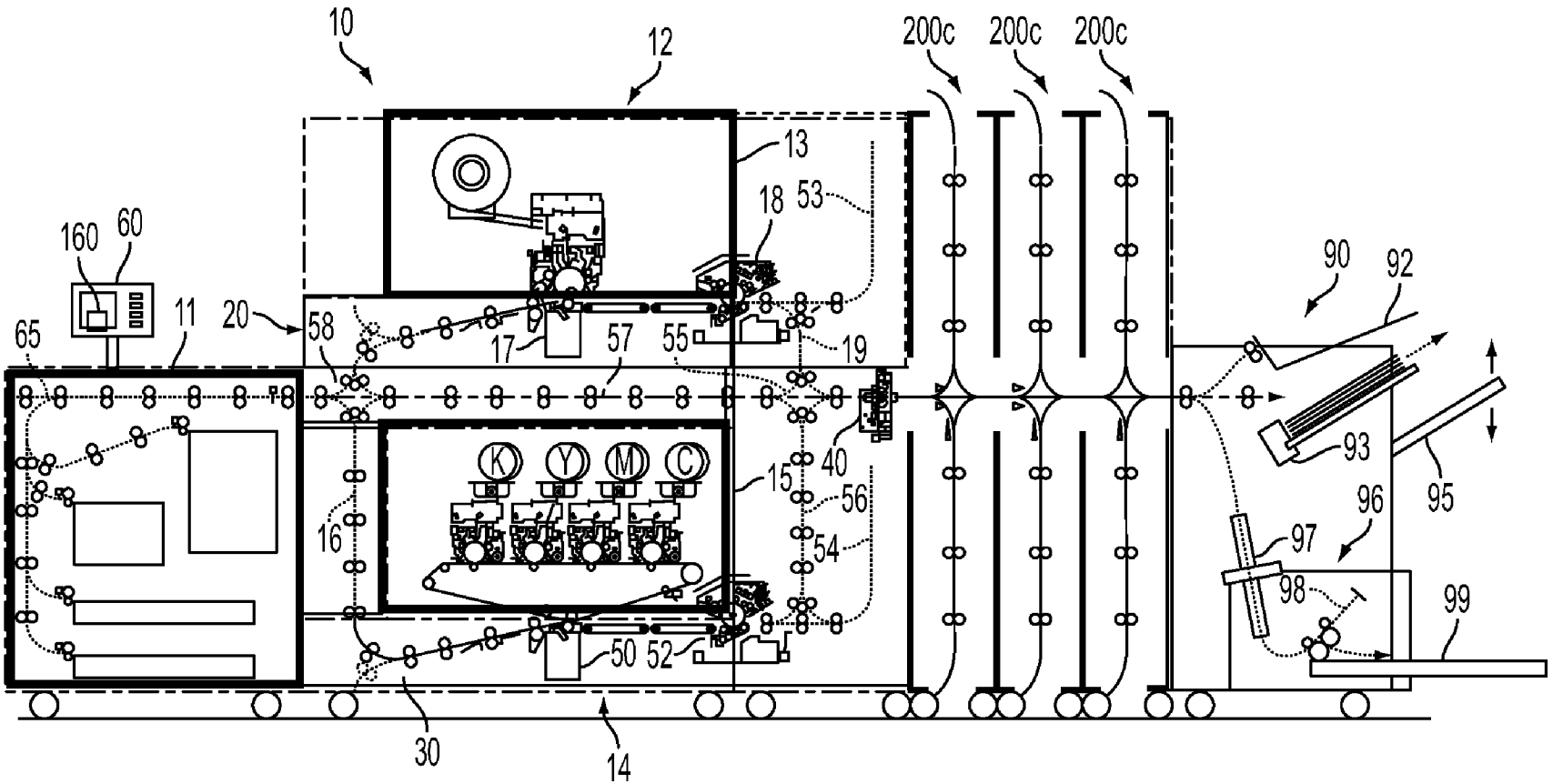
FIG. 10 is a schematic diagram illustrating a modular multi-marking engine printing system incorporating the discrete module of FIG. 6 and, thus, the device of FIG. 3.

As with the modular printing system 10 of FIG. 7, each of the modular printing system embodiments illustrated in FIGS. 8-10 can comprise a first printing engine module 14 (e.g., a multiple color printing engine module) and a second printing engine module 12 (e.g., a single color printing engine module) positioned adjacent to the first printing engine module (e.g., stacked on top of the first printing engine module 14). Additionally, various sheet transport paths can extend between and through the printing engine modules 14, 12 to allow for single color, and multi-color printing in simplex and/or duplex format. The outputs of the printing engine modules 14, 12 can be merged into a single stream of single color sheets and multi-color sheets. Optionally, this single stream can pass through a decurler 40. However, rather than passing from the decurler 40 directly into a finisher module 90, as shown in FIG. 7, this single stream may be directed into a sheet buffering and inverting module (e.g., 200*a*, 200*b*, or 200*c*). Specifically, this single stream may be directed from the decurler 40 into a sheet input port 221 of a sheet buffering and inverting module (e.g., 200*a*, 200*b* or 200*c*) for processing by a sheet buffering and inverting device (e.g., 100*a*, 100*b*, or 100*c*, respectively). As described in detail above, such a device 100*a*, 100*b*, 100*c* can buffer and invert selected sheets such that the stream of sheets received by the finisher module 90 from the sheet output port 222 of the module are in the proper order and orientation (i.e., the pages of the document, as printed by the printing engines 14, 12 and received by the finisher module 90, are properly ordered and oriented).

It should be understood that the controller 160 described above and illustrated in FIGS. 1-3 can be integrated into the control station 60 of the modular printing system 10. The control station 60 can preferably comprise a programmable, self-contained, dedicated mini-computer having a central processor unit (CPU), electronic storage, and a display or user interface (UI) and can function as the main control system for the multiple modules (e.g., the feeder module, printing engine modules, sheet buffering and inverting module(s), etc.) within the modular printing system 10.

As mentioned above, standalone printing systems may benefit from sheet buffering and/or inverting prior to printing by a single printing engine. For example, U.S. Pat. No. 7,305,200 of Hoffman et al. (incorporated by reference above) discloses a printing system (see FIG. 11), which includes a marking engine 18. In this print system, print media, such as paper, is conveyed from a source 20 of print media, such as a paper tray, along a paper pathway 22 which passes through the marking engine 18. A return pathway 24 in the form of a loop can return print media back to the marking engine 18 for additional processing. In one embodiment, the return pathway 24 includes an inverter 26 by which once printed media is inverted once for duplex (two sided) printing. The printing system is connected by a link 102 to a control system 106, which serves as a marking processing component and which may incorporate what is known in the art as a digital front end (DFE). The control system 106 processes received original image data to produce print ready binary data that is supplied to the marking engine 18. In response to the print ready data, the marking engine 18 generates a print image on the print media. Additionally, U.S. Pat. No. 7,305,200 of Hoffman et al. indicates that the printing system is described with particular reference to a xerographic (e.g., laser) printing or marking engine 18; however, alternatively, inkjet, solid ink, bubble jet or other marking engines may be employed.

Figure 11:
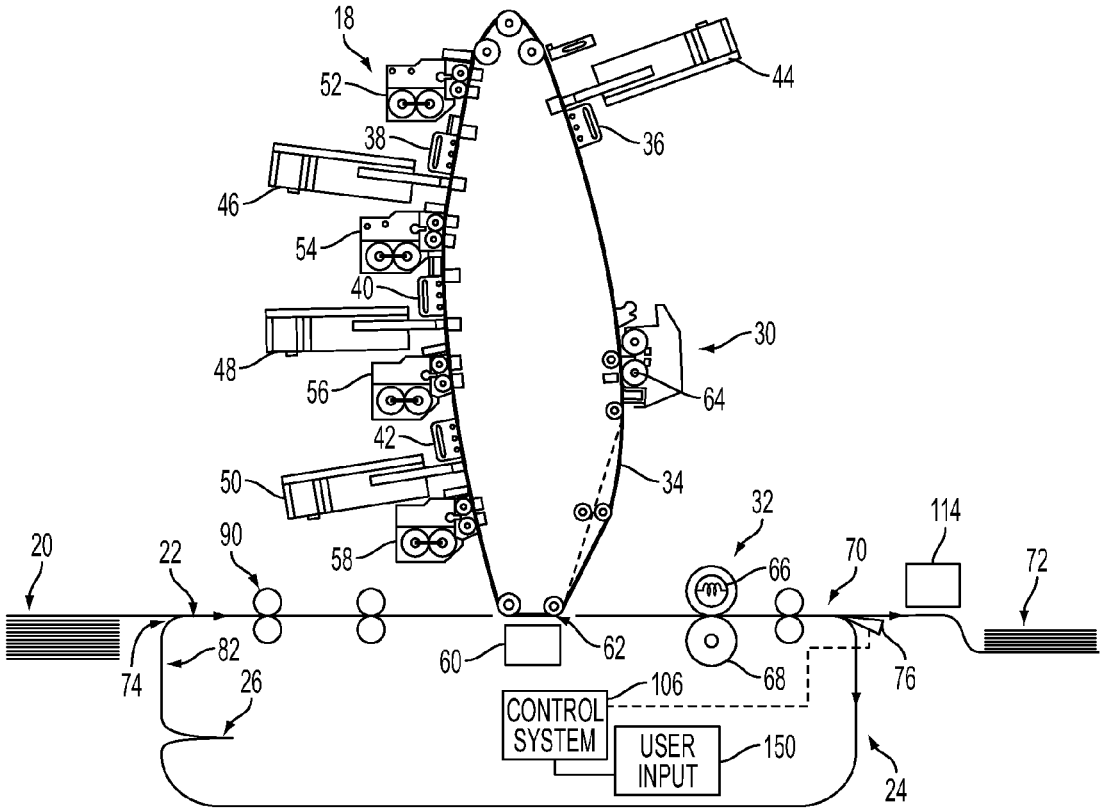
FIG. 11 is a schematic diagram illustrating an exemplary printing system.

Those skilled in the art will recognize that, depending upon the type of marking engine 18, staging may be required prior to processing by the marking engine 18. That is, a sheet may need to be temporarily held until it is determined that the marking engine 18 is ready to receive them. For example, in the case of a multi-pass intermediate transfer marking engine (e.g., as described in detail in U.S. Pat. No. 7,426,043 of Folkins, issued on Sep. 16, 2008, assigned to Xerox Corporation, Norwalk, Conn., and incorporated herein by reference), a sheet may need to be temporarily held until a composite image is formed on an intermediate substrate. Specifically, one type of a multi-pass intermediate transfer marking architecture is used to accumulate composite page images from multiple color separations. On each pass of the intermediate substrate, marking material for one of the color separations is deposited on the surface of the intermediate substrate until the last color separations is deposited to complete the composite image. Another type of multi-pass marking architecture is used to accumulate composite page images from multiple swaths of a print head. On each pass of the intermediate substrate, marking material for one of the swaths is applied to the surface of the intermediate substrate until the last swath is applied to complete the composite image. Both of these examples of multi-pass marking architectures perform what is commonly known as "page printing" once the composite page image is completed by transferring the full page image from the intermediate substrate to the target substrate. However, while the composite image is being formed (i.e., being built up on the intermediate substrate), the sheet onto which it will be transferred must be staged (i.e., temporarily held until the printing engine 18 is ready to receive it) and, as illustrated in FIG. 11, the area allotted for staging between the paper source 20 and the marking engine 18 is typically minimal. To solve this problem, any of the sheet buffering and inverting devices 100*a-c* disclosed herein can be incorporated into a printing system, such as that disclosed in U.S. Pat. No. 7,305,200 of Hoffman et al., in order to allow for a large number of sheets to be simultaneously held (i.e., staged, buffered) in small amount of space, while also acting as duplex inverter.

Figure 12:
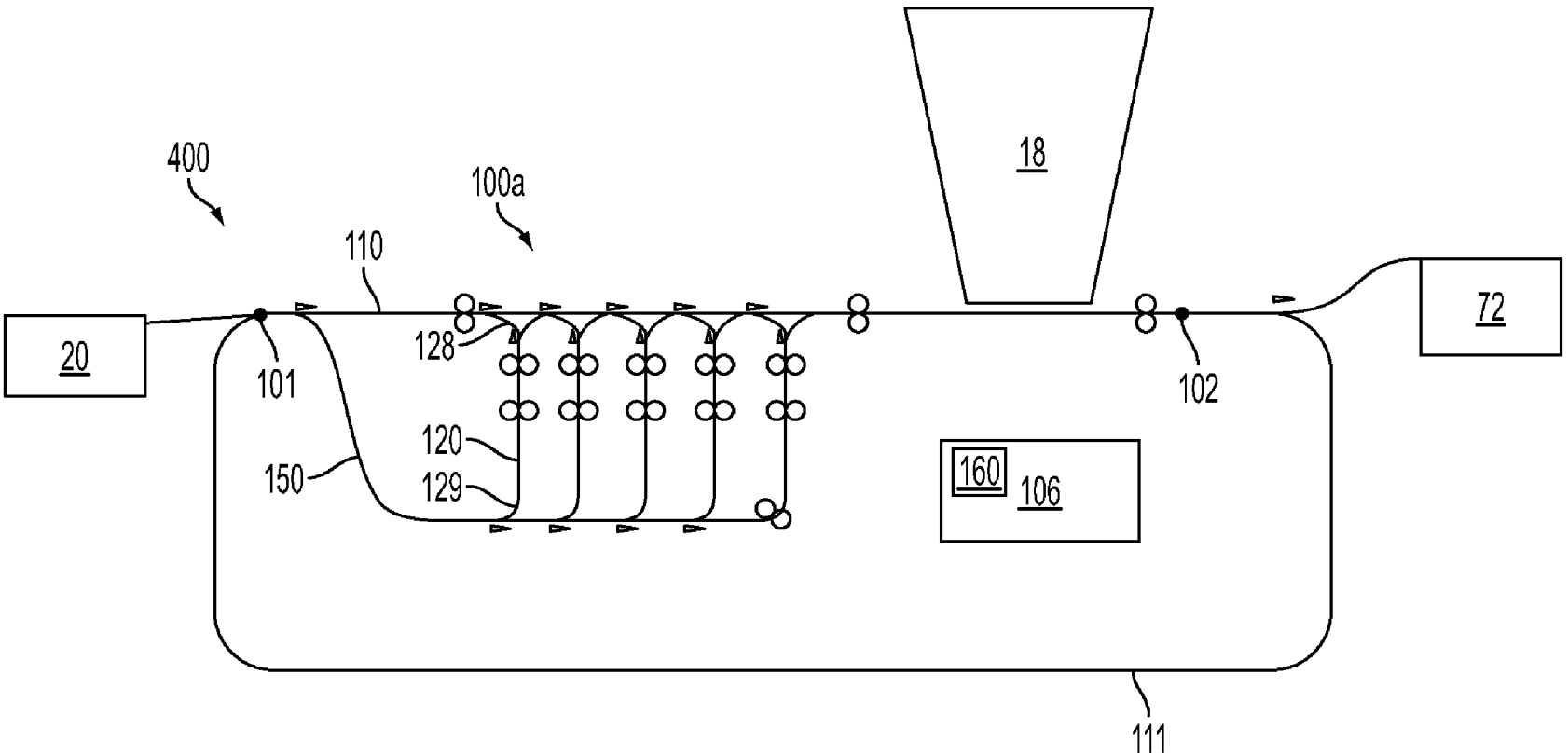
FIG. 12 is a schematic diagram illustrating a printing system, such as the printing system of FIG. 11, incorporating the device of FIG. 1.

For example, FIG. 12 illustrates an exemplary stand alone printing system 400, incorporating a sheet buffering and inverting device. This printing system 400 can comprise a printing engine 18, e.g., a xerographic printing engine, an inkjet printing engine, a solid ink printing engine, a bubble jet printing engine, or any other suitable printing engine. The printing system 400 can further comprise a sheet buffering and inverting device adjacent to the printing engine 18. For illustration purposes, the sheet buffering and inverting device 100*a* of FIG. 1 is shown as being incorporated into the system 400 of FIG. 12; however, those skilled in the art will recognize that alternatively the sheet buffering and inverting device 100*b* of FIG. 2 could be used.

Specifically, the sheet buffering and inverting device 100*a* can comprise a sheet transport path 110 extending from a first location 101 (e.g., a location adjacent to a sheet source 20) to the printing engine 18 and further past the printing engine 18 to a second location 102 (e.g., a location adjacent to a sheet output tray 72 (or other sheet receiving destination). The sheet transport path 110 can further comprise a loop back connection 111 between the second location 102 and the first location 101. A plurality of sheet inverter paths 120, each having a length sufficient to hold one or more print media sheets (e.g., three letter sized sheets (i.e., 8½×11 inch sheets), two 13×19 inch sheets, etc.), can be positioned between the first location 101 and the printing engine 18. Each of the sheet inverter paths 120 can have a first end 128 (i.e., a proximate end) adjacent to the sheet transport path 110 and a second end 129 (i.e., a distal end) opposite the first end 128. An additional sheet transport path 150 can branch from the sheet transport path 110 upstream of the sheet inverter paths 120 (i.e., between the first location 101 and the sheet inverter paths 120). This additional sheet transport path 150 can connect to the distal end 129 of each of the sheet inverter paths 120.

A plurality of gates 121-124 and sheet transport devices 125, as illustrated in FIG. 1 and described in greater detail above, can be selectively controllable so as to cause buffering and/or inverting of sheets by the sheet inverter paths 120 prior to processing of the sheets (e.g., multi-pass or duplex printing) by the printing engine 18. Specifically, a controller 160 can be operatively connected to the gates 121-124 and sheet transport devices 125 and can control actuation of the gates 121-124 and sheet transport devices 125 in order to control movement of sheets into and out of the sheet inverter paths 120 from either end 128 or 129 and, thereby to cause buffering and/or inverting of the sheets prior to processing (e.g., multi-pass or duplex printing) by the printing engine 18. It should be understood that the controller 160 can be integrated into the control system 106, which can preferably comprise a programmable, self-contained, dedicated mini-computer having a central processor unit (CPU), electronic storage, and a display or user interface (UI) and can function as the main control system for the printing system 400.

It should further be understood that the term "printing systems" as used herein encompasses any of a digital copier, bookmaking machine, facsimile machine, multi-function machine, modular printing system, standalone printing system, etc. which performs a print outputting function, and includes one or more printing devices (also referred to herein as "image printing devices", "printing engines", "marking engines", "printing machines", "printers", etc.). Such printing systems are readily available devices produced by manufactures such as Xerox Corporation, Norwalk, Conn., USA. In additional to printing devices, printing systems commonly include input/output, power supplies, processors, media movement devices, etc., the details of which are omitted here from to allow the reader to focus on the salient aspects of the embodiments described herein. The details of printing devices (e.g., printers, printing engines, marking engines, etc.) are well-known by those ordinarily skilled in the art and can include, but are not limited, to xerographic (e.g., laser) printing devices, inkjet printing devices, solid ink printing devices, bubble jet printing devices, etc.

Additionally, the term "print medium" as used herein encompasses any cut sheet or roll of print media suitable for receiving images, pictures, figures, drawings, printed text, handwritten text, etc. Exemplary print media include, but are not limited to, materials such as paper, plastic, and vinyl. The term "buffering" as used herein refers to temporarily holding (i.e., staging) a print media sheet in a sheet inverter path until some predetermined condition occurs (e.g., until proper sheet order can be achieved by inserting the sheets back into at stream of sheets or until a downstream processing unit, such as a printing engine, is ready to receive the sheets). Finally, the phrase "stream of sheets" as used herein refers to print media sheets transported in succession (i.e., one after another) through a sheet transport path.

It should further be understood that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, and/or a combination thereof. Unless specifically defined in a specific claim itself, steps or components of the embodiments herein should not be implied or imported from any above example as limitations to any particular order, number, position, size, shape, angle, color, or material.

Therefore, disclosed above are embodiments of a sheet buffering and inverting device. The device can each include a sheet transport path and multiple sheet inverter paths extending upward and/or downward from the sheet transport path. Selected sheets being transported through the sheet transport path can be diverted into the sheet inverter paths, can be held (i.e., buffered) in the sheet inverter paths, and can subsequently be fed back into the sheet transport path such that they are inverted. Optionally, additional sheet transport path(s) can branch off the sheet transport path upstream of the sheet inverter paths and can connect to the distal end of each sheet inverter path to allow sheets that do not require inverting to also be buffered. The device can be incorporated into a discrete module of a modular printing system in order to ensure sheets are properly merged and oriented after processing by multiple printing engines. Alternatively, the device can be incorporated into a standalone printing system, in order to ensure sheets are properly buffered and/or inverted prior to processing by a single printing engine.

What is claimed is:

1. A sheet buffering and inverting device comprising:

a sheet transport path receiving a stream of sheets at a first location and feeding said stream to a second location, each of said sheets in said stream initially having an orientation with a first edge comprising a leading edge and a second edge opposite said first edge comprising a trailing edge; and a plurality of sheet inverter paths connected to said sheet transport path and being approximately perpendicular to said sheet transport path, each sheet inverter path comprising:

a first end adjacent to said sheet transport path and a second end opposite said first end;

a first gate at said first end diverting a selected sheet from said stream such that said first edge enters said sheet inverter path;

a sheet transport device transporting said selected sheet away from said sheet transport path at least until said second edge is contained within said sheet inverter path, said sheet inverter path buffering said selected sheet and said sheet transport device subsequently reversing direction and transporting said selected sheet back to said sheet transport path such that said selected sheet is inserted back into said stream at said first end; and a second gate guiding said selected sheet, as said selected sheet is inserted back into said stream, such that said selected sheet is inverted with said second edge comprising said leading edge and said first edge comprising said trailing edge; and an additional sheet transport path branching off of said sheet transport path between said first location and said sheet inverter paths and being connected to a least one of said sheet inverter paths at said second end, said additional sheet transport path comprising additional sheet transport devices and additional gates that allow an additional selected sheet to be diverted into said additional sheet transport path and transported into said at least one of said sheet inverter paths at said second end so that said additional selected sheet is buffered and also maintains said orientation when subsequently inserted back into said stream at said first end.

2. The device of claim 1, said device being contained within one of a stand alone printing system and a discrete module incorporated into a modular printing system.

3. The device of claim 1, said sheet transport path extending essentially horizontally between said first location and said second location and said sheet inverter paths extending essentially vertically from said sheet transport path.

4. The device of claim 3, said sheet inverter paths comprising at least one upper sheet inverter path positioned above said sheet transport path and at least one lower sheet inverter path positioned below said sheet transport path.

5. The device of claim 1, said buffering comprising holding said selected sheet for a period of time so that any one of the following conditions occur:

said selected sheet is subsequently inserted back into said stream in order to achieve a specific sheet order; and a downstream processing unit is ready to receive said selected sheet.

6. The device of claim 1, further comprising a controller operatively connected to said sheet inverter paths and controlling movement of sheets into and out of said sheet inverter paths.

7. The device of claim 1, said sheet inverter paths each having a length sufficient to hold multiple print media sheets.

8. A sheet buffering and inverting module comprising:

a frame having a first side and a second side opposite said first side;

a sheet transport path extending essentially horizontally across said frame from a sheet input port on said first side to a sheet output port on said second side, said sheet transport path receiving a stream of sheets at said sheet input port and feeding said stream to said sheet output port, each of said sheets in said stream initially having an orientation with a first edge comprising a leading edge and a second edge opposite said first edge comprising a trailing edge; and a plurality of sheet inverter paths connected to and extending essentially vertically from said sheet transport path, each sheet inverter path comprising:

a first end adjacent to said sheet transport path and a second end opposite said first end;

a first gate at said first end diverting a selected sheet from said stream such that said first edge enters said sheet inverter path;

a sheet transport device transporting said selected sheet away from said sheet transport path at least until said second edge is contained within said sheet inverter path, said sheet inverter path buffering said selected sheet and said sheet transport device subsequently reversing direction and transporting said selected sheet back to said sheet transport path such that said selected sheet is inserted back into said stream at said first end; and a second gate guiding said selected sheet, as said selected sheet is inserted back into said stream, such that said selected sheet is inverted with said second edge comprising said leading edge and said first edge comprising said trailing edge; and an additional sheet transport path branching off of said sheet transport path between said first location and said sheet inverter paths and being connected to a least one of said sheet inverter paths at said second end, said additional sheet transport path comprising additional sheet transport devices and additional gates that allow an additional selected sheet to be diverted into said additional sheet transport path and transported into said at least one of said sheet inverter paths at said second end so that said additional selected sheet is buffered and maintains said orientation when subsequently inserted back into said stream at said first end.

9. The module of claim 8, said sheet inverter paths comprising at least one of the following:

multiple upper sheet inverter paths positioned above said sheet transport path; and multiple lower sheet inverter paths positioned below said sheet transport path.

10. The module of claim 8, said buffering comprising holding said selected sheet for a period of time so that any one of the following conditions occur:

said selected sheet is subsequently inserted back into said stream in order to achieve a specific sheet order; and a downstream processing unit is ready to receive said selected sheet.

11. The module of claim 8, said sheet inverter paths comprising a single upper sheet inverter path positioned above said sheet transport path and a single lower sheet inverter path positioned below said sheet transport path.

12. The module of claim 8, further comprising a controller operatively connected to said sheet inverter paths and controlling movement of sheets into and out of said sheet inverter paths.

13. The module of claim 8, said sheet inverter paths each having a length sufficient to hold multiple print media sheets.

14. A printing system comprising:

a first printing module;

a second printing module adjacent said first printing module; and at least one sheet buffering and inverting module comprising:

a frame having a first side and a second side opposite said first side;

a sheet transport path extending essentially horizontally across said frame from a sheet input port on said first side to a sheet output port on said second side, said sheet transport path receiving a stream of sheets at said sheet input port, said stream of sheets comprising a merged stream of sheets from both said first printing module and said second printing module, each of said sheets in said stream initially having an orientation with a first edge comprising a leading edge and a second edge opposite said first edge comprising a trailing edge, said sheet transport path further feeding said stream to said sheet output port; and a plurality of sheet inverter paths connected to and extending essentially vertically from said sheet transport path, each sheet inverter path comprising:

a first end adjacent to said sheet transport path and a second end opposite said first end;

a first gate at said first end diverting a selected sheet from said stream such that said first edge enters said sheet inverter path;

a sheet transport device transporting said selected sheet away from said sheet transport path at least until said second edge is contained within said sheet inverter path, said sheet inverter path holding said selected sheet and said sheet transport device subsequently reversing direction and transporting said selected sheet back to said sheet transport path such that said selected sheet is inserted back into said stream at said first end; and a second gate guiding said selected sheet, as said selected sheet is inserted back into said stream, such that said selected sheet is inverted with said second edge comprising said leading edge and said first edge comprising said trailing edge; and an additional sheet transport path branching off of said sheet transport path between said first location and said sheet inverter paths and being connected to a least one of said sheet inverter paths at said second end, said additional sheet transport path comprising additional sheet transport devices and additional gates that allow an additional selected sheet to be diverted into said additional sheet transport path and transported into said at least one of said sheet inverter paths at said second end so that said additional selected sheet maintains said orientation when subsequently inserted back into said stream at said first end.

15. The printing system of claim 14, said first printing module comprising a multi-color printing module and said second printing module comprising a single color printing module.

16. The printing system of claim 14, said sheet inverter paths comprising at least one of the following:

multiple upper sheet inverter paths positioned above said sheet transport path; and multiple lower sheet inverter paths positioned below said sheet transport path.

17. The printing system of claim 14, said buffering comprising holding said selected sheet for a period of time so that any one of the following conditions occur:

said selected sheet is subsequently inserted back into said stream in order to achieve a specific sheet order; and a downstream processing unit is ready to receive said selected sheet.

18. The printing system of claim 14, said at least one sheet buffering and inverting module comprising multiple sheet buffering and inverting modules; and said sheet inverter paths in each of said modules comprising a single upper sheet inverter path positioned above said sheet transport path and a single lower sheet inverter path positioned below said sheet transport path.

19. The printing system of claim 14, further comprising a controller operatively connected to said sheet inverter paths and controlling movement of sheets into and out of said sheet inverter paths.

20. The printing system of claim 14, said sheet inverter paths each having a length sufficient to hold multiple print media sheets.

21. A printing system comprising:

a printing engine; and a sheet buffering and inverting device comprising:

a sheet transport path extending from a first location to a printing engine and further past said printing engine to a second location, said sheet transport path further comprising a loop back connection from said second location to said first location;

a plurality of sheet inverter paths positioned between said first location and said printing engine, each of said sheet inverter paths being essentially perpendicular to said sheet transport path and having a first end adjacent to said sheet transport path and a second end opposite said first end;

an additional sheet transport path branching off from said sheet transport path between said first location and said sheet inverter paths, said additional sheet transport path connecting to said second end of each of said sheet inverter paths; and a plurality of gates and sheet transport devices, said gates and said sheet transport devices being selectively controllable, prior to processing of said sheets by said printing engine, so as to cause buffering and inverting of some selected sheets by diverting said selected sheets directly from said sheet transport path into said sheet inverter paths at said first end and to further cause buffering only of additional selected sheets by diverting said additional selected sheets into said sheet inverter paths at said second end via said additional sheet transport path.

* * * * *